United States Patent [19]

Dreyfuss et al.

[11] Patent Number: 4,599,778

[45] Date of Patent: Jul. 15, 1986

[54] INSTALLING OR CENTERING MECHANISM FOR PIPES TO BE SCREWED INTO ONE ANOTHER

[75] Inventors: Wilfried Dreyfuss, Dortstrasse 52, D-3111 Eimke, Fed. Rep. of Germany; Thomas E. Remp, 5555 Del Monte Dr., Houston, Tex. 77056; Kurt Müller, Eicklingen, Fed. Rep. of Germany

[73] Assignees: Wilfried Dreyfuss, Eimke, Fed. Rep. of Germany; Thomas E. Remp, Houston, Tex.

[21] Appl. No.: 643,476

[22] Filed: Apr. 30, 1984

[30] Foreign Application Priority Data

Apr. 30, 1983 [DE] Fed. Rep. of Germany ..... 3315752
Sep. 3, 1983 [DE] Fed. Rep. of Germany ..... 3331867

[51] Int. Cl.[4] ..... B25B 27/14
[52] U.S. Cl. ..... 29/272
[58] Field of Search ..... 29/271, 272, 282, 270; 81/417, 425 R; 269/239, 268; 175/220; 166/77.5, 85; 82/45

[56] References Cited

U.S. PATENT DOCUMENTS 4,079,493 3/1978 Oygarden et al. ..... 29/272
4,213,237 7/1980 Whiting ..... 2/272

*Primary Examiner*—Robert C. Watson
*Attorney, Agent, or Firm*—Schlesinger, Arkwright, Garvey & Fado

[57] ABSTRACT

The invention relates to an inserting and centering device for associated screw-in pipes. Two semi-cylindrical jaws are connected in articulating manner on the cylindrical inside surfaces of which are provided an annular projection having an annular, downward shoulder to rest on the socket edge of the pipes.The jaws further comprise, at their upper end, a conical flare joining the said projection. Each jaw is equipped with one handle. the device further includes a closure mechanism to keep together the jaws when they are in the closed position wherein the jaws enclose with play the pipe socket. One handle of at least one jaw at the same time is designed to be a part of the closure mechanism.

19 Claims, 8 Drawing Figures

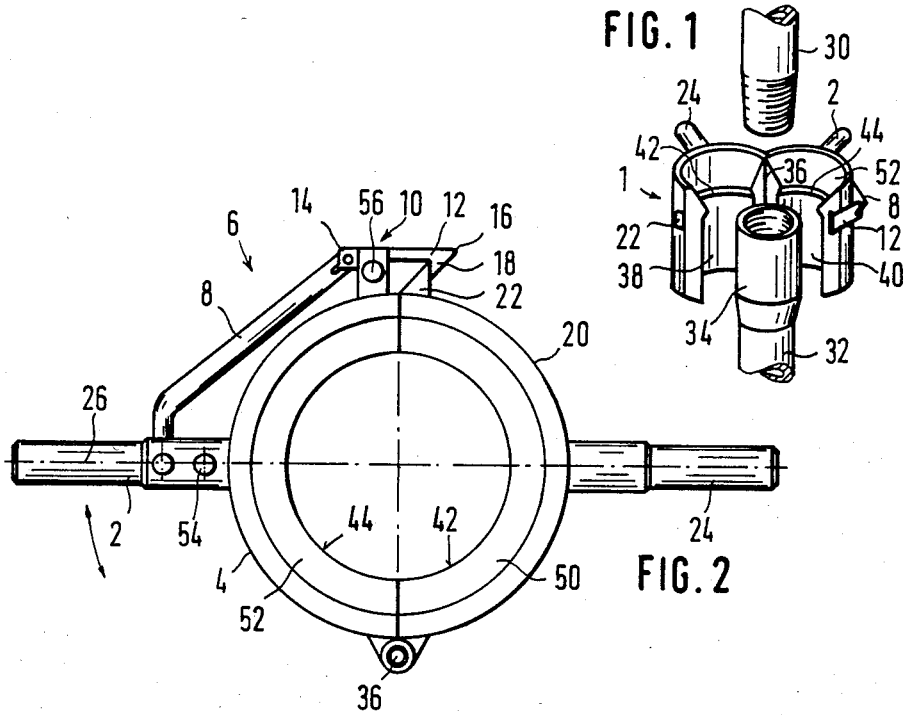
FIG. 2
FIG. 1
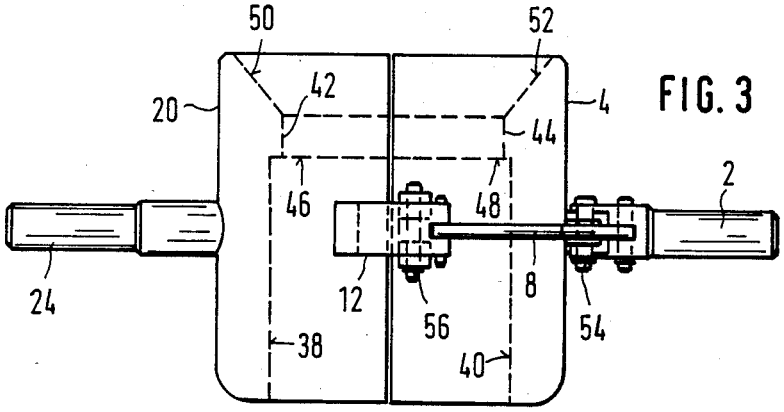
FIG. 3

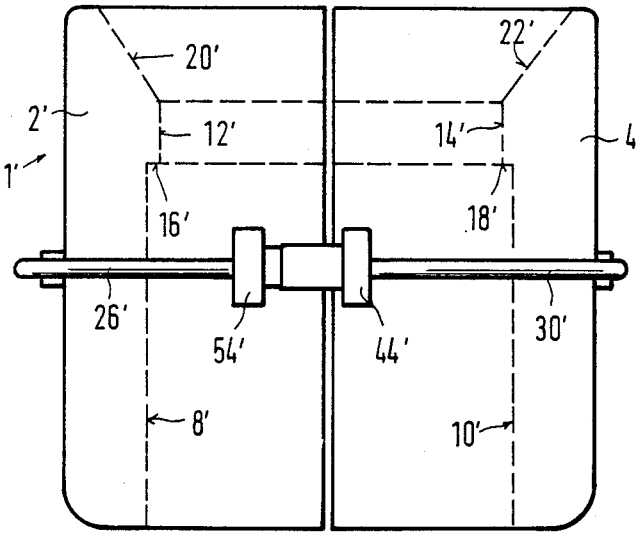
FIG. 4
FIG. 5
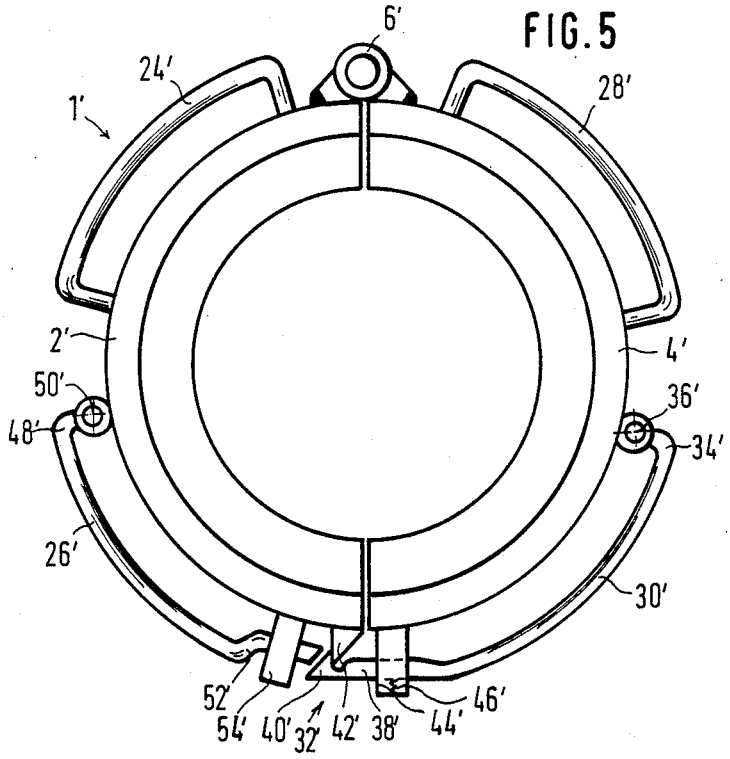

INSTALLING OR CENTERING MECHANISM FOR PIPES TO BE SCREWED INTO ONE ANOTHER

BACKGROUND OF THE INVENTION

The invention concerns a device for inserting and centering associated screw-in pipes.

Such known devices are provided with handles near the open end of the jaws. When the jaws are closed, the handles subtend an acute angle and point to the operator. The closure means is separately made in the form of a droplatch. This design suffers from the drawback that when opening the closure means, the engagement must be loosened around one of the handles, which, in view of the devices most of the time being rather heavy, can become problematical. Another drawback is that, after the jaws are opened, the device can only be removed toward the rear as seen by the operator, so that one hand must be left free and only the other hand is available to hold the heavy device. Where space permits, the operator also may stand on the side opposite the closure means, in which case, however, the handles can only be seized with difficulty because they are on the opposite side and pointing away from the operator Furthermore, operating the closure means is also rendered more difficult.

OBJECTS AND SUMMARY OF THE INVENTION

It is the object of the present invention to so improve the device so that handling is made easier thereby.

This problem is solved by the characteristics of the design of the invention.

The especial advantage of the solution of the invention is that one of the handles is simultaneously designed to also be a part of the closure means. As a result, the required change of hands of the known device is eliminated and accordingly the device can always be fully held with both hands. Moreover, the design of the invention permits operation of the device from the hinge side in such a manner that the device can always be applied from the front and can always be removed toward the front. Thereby, handling is substantially facilitated. This device is especially suited for pipes of smaller diameters so that single-man operation is wholly feasible. Pipes of larger diameters require correspondingly larger devices, demanding more than one-man operation.

A device for handling such pipes of larger diameters is also disclosed. This device is designed in such a manner that two operators can handle it, also being assured to pipes of very large diameters. The especial advantage offered thereby is that one of the handles is designed as part of the closure means. Consequently, the operation of quite heavy device is made appreciably easier.

Advantageous and appropriate further developments of the embodiments are disclosed. If, furthermore, the handle of the other jaw, which is close to the closure means, is also designed to be an opening means for the closure, then an additional advantage is that the device of the invention can be opened from each side. This advantage is especially significant when the heavy device of the invention hangs from a cable, as it often does in practice, so that the device can be opened from the side nearest the operator who no longer has to change sides.

The invention is discussed below in further detail in relation to the enclosed drawings showing illustrative embodiments.

DESCRIPTION OF THE DRAWINGS

FIG. 1 is a perspective of a first embodiment of the device of the invention when in the open state, together with two pipe ends to be joined;

FIG. 2 is a topview of the device of the invention of FIG. 1 when in the closed state;

FIG. 3 is a sideview of the device of FIG. 1 looking onto the closure means;

FIG. 4 is a sideview of a second embodiment of the device of the invention, looking onto the closure means;

FIG. 5 is a topview of the device of FIG. 4;

Figure 6:
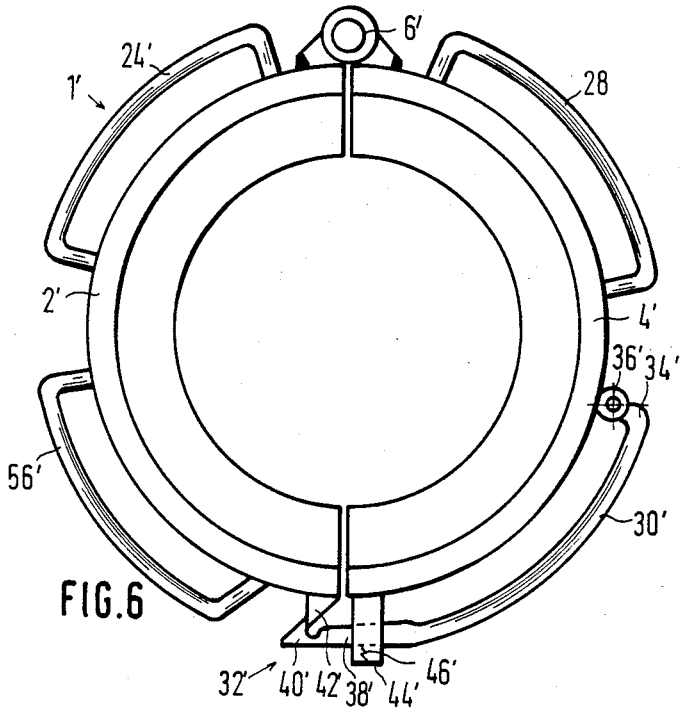
FIG. 6 is a third embodiment of the device of the invention, seen in topview; and, FIG. 7 is a fourth embodiment of the device of the invention, seen in topview.

The drawing of FIGS. 1 through 3 shows an insertion and centering device for associated screw-in pipes 30, 32, in particular for sinking pipes. The device comprises two semi-cylindrical jaws 4, 20 jointly articulating by means of a hinge or joint 36. Annular projections 42 and 44, each with a downward annular shoulder 46 and 48, respectively, are provided on the cylindrical inner surfaces 38, 40 of these jaws. The device rests by means of this shoulder on the edge of the socket 34 of the pipe 32 while the pipes being assembled. The jaws are provided at their upper ends with conically flaring parts 50 and 52, respectively, which join the projections. Handles 2 and 24, respectively, are mounted on the outside of the jaws and approximately centrally thereof.

The handle 2 of the jaw 4 is designed as part of the closure means 6. For that purpose, the handle 2 pivots about an axis 54 and about the jaw 4. A rotatably supported connecting rod 8 connects the handle 2 with the one free end 14 of a double lever 12 which pivots about an axis 56 and which is also mounted on the jaw 4. The other free end 16 of the double lever includes a hook 18 which, in the closed jaw position, overlaps tooth 22 mounted on the other jaw 20, as best shown in FIG. 2. Preferably, the locking system 10 is of the self-latching snap-in type.

When the two jaws are closed, the handles 2, 24, are diametrically opposite each other.

Figure 8:
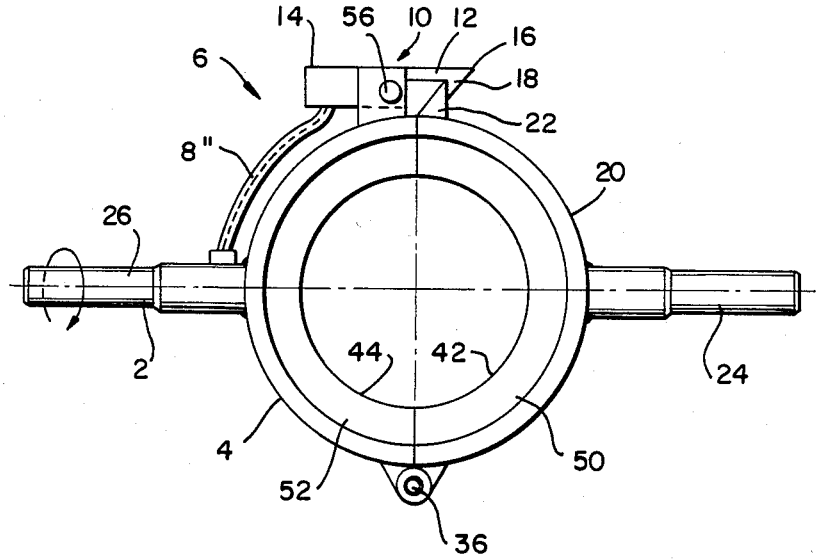
FIG. 8 is a top view of another embodiment of the invention.

In an alternative embodiment to the embodiment shown in the FIGS. 1–3, the handle 2 also can be made to be rotational about its horizontal axis 26. In that case, it is not the pivoting but the rotational motion which is transmitted to the locking system 10, implemented for instance also by a bowden cable 8'', as best shown in FIG. 8, in lieu of the connection rod 8.

FIGS. 1–3 illustrate the components of the closure means 6 of the locking system 10 as elements mounted on the jaws. The closure-means components (exception, of course, being made of the handle 2), however, can be designed to be sunk in part or in whole into the jaws (omitted).

The inserting and centering device for associated screw-in pipes shown in the drawings takes into account optimal biotechnical factors. Obviously, the handles 2 and 24 can be mounted centrally, that is, diametrically when the closed position is achieved. Furthermore, they may also be closer to the hinge 36. The design shown and described, in any event, assures that the device can be applied from the front and can also be removed toward the front, whereby its operation is substantially made easier.

The drawings of FIGS. 4 through 7 show an insertion and centering device 1' for associated screw-in pipes, in particular for the sinking of pipes.

Figure 7:
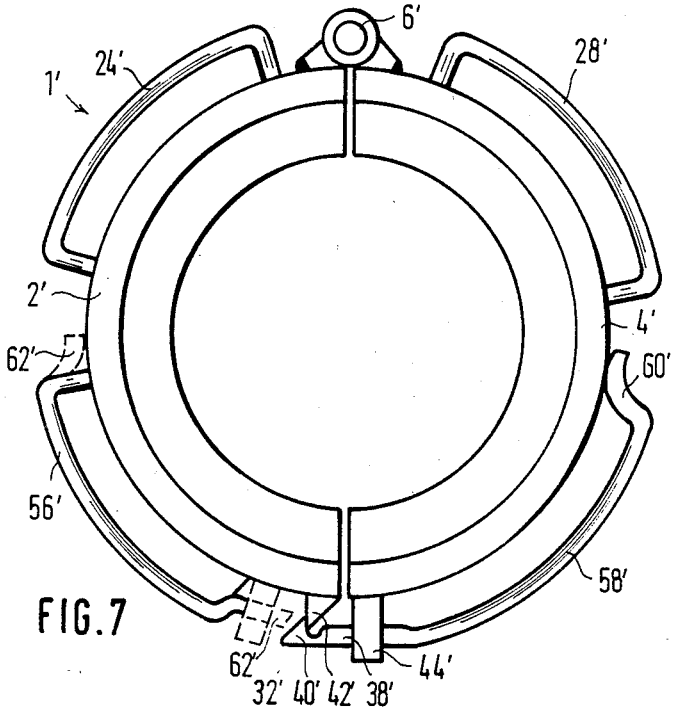

The embodiment of FIGS. 4–7 includes two semi-cylindrical jaws 2' and 4' connected together in articulating manner by a hinge or a joint 6'. The cylindrical inside surfaces 8', 10' of these jaws are provided with annular projections 12', 14', each with a downward annular shoulder 16' and 18', respectively. By means of these shoulders, the device rests on the edge of the socket of the pipe when in the assembled state. The jaws are provided at their upper ends with a conical flaring 20' and 22', respectively, joining the projections 12' and 14', respectively. Two handles 24', 26' and 28', 30', respectively, as best shown in FIG. 5, are mounted next to each other around the circumference of the jaws 2' and 4', and assume the shape of bails. The bail 30' of the jaw 4' is part of closure means 32'. To that end, the bail 30' is mounted to be pivotable at its one end 34' about an axis 36'. A hook 40' is formed at the other end 38' of the bail 30' and overlaps tooth 42' mounted on the other jaw 2' when these jaws are closed, as best shown in FIGS. 5 through 7. Preferably, the closure means 32' is self-latching. The end 38' of the bail 30' passes through a U-shaped or rectangular eye 44' which acts as a guide means and as a stop for the pivoting motion. A compression spring 46' is mounted within the eye to load the pivoting bail 30' towards the closed position.

In the embodiment shown in FIG. 5, the bail 26' of the other jaw 2' is adjacent the closure means 32' and also is pivotable, providing a closure-means opener. To that end, the bail 26', just as bail 30', is mounted in pivotable manner by its one end 48' about a fulcrum 50' on the jaw 2'. The other free end 52' of the bail 26' passes underneath the outer end, i.e. the hook 40' of the bail 30' in such a manner that bail 30' is moved by the outward pivoting motion of the bail 26' from the closed position into the open position. The end 52' of the bail 26' also passes through a U-shaped or rectangular eye 54' which acts as a guide. A compression spring may be mounted also in this eye 54' to load the bail 26' toward the closed position of the closure means 32'. However, such a spring is not mandatory.

Furthermore, the loading of the bail 30' and/or 26' can be implemented by using torsion springs mounted in the vicinity of the fulcra 36' or 50'.

FIG. 6 shows a simplified design of the inserting and centering device. In this embodiment, the bail 26' of FIG. 5 is designed as a fixed bail 56', as are the bails 24' and 28'. Otherwise, the device of FIG. 6 is identical with that of FIG. 5. The same components for the two devices therefore are denoted by the same references and the description relating to FIG. 5 should be considered for further accounts.

FIG. 7 shows a third embodiment of the inserting and centering device. The bail 30' of the devices of FIGS. 5 and 6 is designed to be a spring-steel bail 58'. This spring-steel bail 58' is rigidly mounted at its end 60' to the jaw 4' and is loaded by its own stress in the direction of closing of the closure means 32'. In the device of FIG. 7, the bail near the closure means 32' also is designed to be a fixed bail 56'. This bail 56', however, may be designed also to be an elastic bail 62' and may, like the bail 26' of FIG. 5, serve as a closure-means opener. Otherwise, the embodiment of FIG. 7 corresponds to the devices of FIGS. 5 and 6. Accordingly, the components identical with those of the devices of FIGS. 5 and 6 are denoted by the same references and to prevent unnecessary repetitions the descriptions relating to FIGS. 5 and 6 should be considered.

The inserting and centering device of FIGS. 4 through 7 is intended especially for pipes of substantial diameters. As these devices are correspondingly heavy, they require operation by two men and they must be knocked around the pipe socket. In the embodiment of FIG. 6, the device can be opened only by means of the one bail 30'. On the other hand, in the embodiment of FIG. 5, the device can be opened by either of the two handles 30' or 26'. Due to the large weight of the device, it will frequently be suspended from a cable and the opening then can be implemented every time by one man from the side closest to him.

What we claim is:

1. An inserting and centering for associated screw-in pipes, comprising:

(a) first and second semi-cylindrical jaws, each of said jaws has a first end portion and a second end portion;

(b) means associated with said first end portions articulatably connecting said jaws;

(c) each of said jaws has an inside surface, including an annular projection for resting on the socket edge of a pipe and further including a conical flaring portion extending from an upper end of each projection;

(d) closure means associated with said second end portions for locking said jaws together in a closed position; and, (e) handle means mounted to one of said jaws and operably associated with said closure means for unlocking said closure means.

2. The device of claim 1, wherein:

(a) said handle means having a first end pivotally mounted to said one jaw and a second end thereof associated with said closure means.

3. The device of claim 2, wherein:

(a) said closure means including a locking system comprising a tooth mounted to one of said jaws and a double lever associated with the other jaw and having a free end including a hook portion adapted to overlap and engage said tooth for locking said jaws in said closed position and said lever having another end connected to said handle means second end.

4. The device of claim 1, wherein:

(a) said handle means including a first handle operable associated with said closure means mounted on one of said jaws and a second handle mounted to the other one of said jaws, said handles being diametrically opposed when said jaws are in said closed position.

5. The device of claim 1, wherein:

(a) said handle means adapted for rotation on the longitudinal axis thereof.

6. The device of claim 1, wherein:

(a) a bowden cable operable connecting said handle means with said closure means.

7. The device of claim 1 wherein:

(a) said articulating means including a hinge.

8. The device of claim 3, wherein:

(a) means pivotally mounting said lever to said other jaw.

9. An inserting and centering device for associated screw-in pipes, comprising:

(a) first and second semi-cylindrical jaws articulatably interconnected at associated first ends thereof;

(b) each of said jaws has an inside surface including an annular projection with an annular shoulder adapted for resting on the socket edge of a pipe and further including a conical flaring portion extending from an upper end portion of each projection;

(c) said jaws have free portions;

(d) closure means associated with free end portions for locking said jaws in a closed position; and, (e) a plurality of handle means mounted to and extending about the circumference of said jaws, one of said handle means operable associated with said closure means for unlocking said closure means.

10. The device of claim 9, wherein:

(a) a second one of said handle means has a first end pivotally mounted to one jaw and a second end including a first closing element operably associated with a second closure element of said closure means mounted to the other jaw for locking said jaws together.

11. The device of claim 10, wherein:

(a) said second handle means including a bail with a hook proximate said second end; and, (b) said second closing element including a tooth adapted for being overlapped by and thereby lockingly engaged with said hook.

12. The device of claim 9, wherein:

(a) each of said jaws having two handle means mounted thereto, each of said handle means including a bail.

13. The device of claim 10, wherein:

(a) said one handle means being mounted to said first jaw and said second handle means being mounted to said second jaw, said first handle means operably associated with said second closing element for unlocking said closure means.

14. The device of claim 13, wherein:

(a) said one handle means having a first end pivotally mounted to said first jaw and a second end engagable with said second closing element.

15. The device of claim 14, wherein:

(a) said second closing element including a hook portion and said one handle second end adapted for passing underneath said hook portion for pivoting said second handle means out of said closed position.

16. The device of claim 10, wherein:

(a) spring means being associated with said second handle means for loading said second handle means into said closed position.

17. The device of claim 16, wherein:

(a) an eye being mounted to said other jaw proximate said second closing element and having an aperture through which said second handle means passes.

18. The device of claim 17, wherein:

(a) said spring means being positioned in said aperture engagable with said second handle means.

19. The device of claim 9, wherein:

(a) a first closing element being mounted to the jaw having said one handle means; and, (b) a second handle means including a second closing element being mounted to the other jaw, said second handle means including a spring-steel bail which is pre-stressed when said closure means is in said closed position and said bail having an end rigidly connected to the associated jaw.

* * * * *